US006575357B1

(12) United States Patent
Rundell

(10) Patent No.: US 6,575,357 B1
(45) Date of Patent: Jun. 10, 2003

(54) RURAL MAILBOX FLAGS

(76) Inventor: James Frederick Rundell, 4181 Judy Dr., Harrison, MI (US) 48625

( * ) Notice: Subject to any disclaimer, the term of this patent is extended or adjusted under 35 U.S.C. 154(b) by 0 days.

(21) Appl. No.: 09/667,030

(22) Filed: Sep. 21, 2000

Related U.S. Application Data

(60) Provisional application No. 60/155,618, filed on Sep. 23, 1999.

(51) Int. Cl.[7] ..... B65D 91/00
(52) U.S. Cl. ..... 232/35
(58) Field of Search ..... 232/35, 34, 17, 232/45

(56) References Cited

U.S. PATENT DOCUMENTS 3,482,543 A * 12/1969 Guidos ..... 232/35
3,516,383 A * 6/1970 Goodman ..... 232/35
3,648,924 A * 3/1972 Burns ..... 232/35
3,960,317 A * 6/1976 Clement ..... 232/35
4,138,056 A * 2/1979 Sherrill ..... 232/35
4,491,268 A * 1/1985 Faulkingham ..... 232/35
4,711,391 A * 12/1987 Roge et al. ..... 232/35
5,076,337 A * 12/1991 Reuter ..... 232/35
5,123,590 A * 6/1992 Teele ..... 232/35
5,366,148 A * 11/1994 Schreckengost ..... 232/35
5,762,264 A * 6/1998 Ginsberg ..... 232/35
5,816,489 A * 10/1998 Stockman ..... 232/35
5,865,368 A * 2/1999 Taylor et al. ..... 232/35
5,964,401 A * 10/1999 Thill ..... 232/35

* cited by examiner

*Primary Examiner*—Lynne H. Browne
*Assistant Examiner*—James M. Hewitt
(74) *Attorney, Agent, or Firm*—Reising, Ethington, Barnes, Kisselle, Learman & McCulloch, P.C.

(57) ABSTRACT

The rural mailbox has a rigid flag that is raised by a Post Office patron to indicate that there is outgoing mail in the mailbox. The mail carrier lowers the rigid flag when outgoing mail is removed from the mailbox. Opening the mailbox lid to place incoming mail in the box releases a flexible flag pole to raise a flag that indicates the mailbox has been serviced by the mail carrier. Following removal of incoming mail from the mailbox, the mailbox lid is closed and the flag shaft tip is inserted into the flag shaft tip holder plate to indicate any incoming mail in the mailbox has been removed.

15 Claims, 2 Drawing Sheets

RURAL MAILBOX FLAGS

This application claims the benefit of U.S. Provisional Application(s) No(s).: 60/155,618 Filed Date Sep. 23, 1999.

TECHNICAL FIELD

The invention relates to a rural mailbox with two flags and more particularly to a mailbox with a primary flag that indicates there is mail to be picked up by a postal employee and a secondary flag that indicates there is mail for a post office patron. The disclosure incorporates the rural mailbox flags disclosed in provisional patent application Serial No. 60/155,618, filed Sep. 23, 1999, whose priority is claimed for this application.

BACKGROUND OF THE INVENTION

Rural mailboxes, which are serviced by mail carriers from a vehicle in some urban areas as well as rural areas, have a pivotally attached rigid flag on an outer side wall. A postal patron pivots the rigid flag upward to a generally vertical position when there is something in the mailbox for a postal employee to pick up such as letters that are being sent to another address. The postal employee stops and checks the mailbox when the rigid flag is pivoted to the upright position whether he has mail to deliver to the mailbox or not. After checking the mailbox, the employee pivots the rigid flag to a generally horizontal storage position.

The postal patron can determine that the rigid flag has been pivoted to a lowered storage position from a moderate distance. When the rigid flag has been lowered the patron knows that incoming mail is likely to be in the mailbox and that the mailbox should be checked and mail in the mailbox should be removed. However, most postal patrons do not place outgoing mail in their mailboxes for pick up by a postal employee. For security reasons most postal patrons deliver outgoing mail to a post office receiving facility such as a locked steel receiving box or a post office. Patrons who use the pivoted rigid flag and place their outgoing mail in their mailbox generally do not have outgoing mail everyday or every other day. The rigid flag would remain down and would not indicate incoming mail is in the mailbox on days that there is no outgoing mail.

Postal employees stop at a rural mailbox only if they have mail to deliver to the mailbox or if the rigid flag is pivoted to an upright and raised position. Some postal patrons do not receive mail everyday. On days that they do not receive incoming mail, the rigid flag will be lowered by a postal employee when picking up outgoing mail.

A lowered rigid flag that is pivotally attached to rural mailboxes will on occasion indicate that mail has been delivered to the mailbox and that this mail should be retrieved. However, the rigid flag was not intended to indicate that a postal employee has delivered mail to the mailbox and will generally not indicate that there is mail in the mailbox for a variety of reasons including the above examples.

Rural mailboxes, which are serviced by a postal employee from a vehicle, are generally some distance from the home or office, of post office patrons. While going to and from their mailboxes, patrons are subjected to all of the weather variations of the locality. There can be extreme heat or cold, precipitation and wind. To avoid extreme weather condition as well as unnecessary walks, most people would prefer to go to their mailbox only when there is incoming mail in the mailbox.

SUMMARY OF THE INVENTION

The mailbox has a floor, a rear wall, side walls, a top, and an open front. A mailbox lid is pivotally attached to the side walls adjacent to the floor for pivotal movement between a closed position in which the open front of the mailbox is closed and an open position. In the open position, the mailbox lid extends generally horizontally away from the rear wall and a forward edge of the floor.

A flexible flag shaft has a base attached to the mailbox adjacent to the rear wall. The flag shaft base is held in a position in which a free end of the shaft tends to extend vertically upward from the base. A flag is secured to the flag shaft near the free end.

A flag shaft tip holder plate is attached to the mailbox lid so as not to interfere with opening and closing of the lid. A portion of the holder plate extends outwardly from an edge of the mailbox lid. An aperture in a portion of the holder plate that extends outwardly from an edge of the mailbox lid receives the free end of the flexible shaft and holds the free end in a lowered position when the lid is closed. Opening the mailbox lid releases the free end of the flag shaft. Upon release of the free end of the flexible flag shaft, the flag shaft straightens and the flag is raised to a position in which it can be seen and identified from a substantial distance.

The flexible flag shaft raises the flag upon opening of the mailbox lid by a postal employee to deposit mail in the mailbox. Movement of the free end of the flag shaft to raise the flag is in an arc up and to the rear of the mailbox lid. After the postal patron removes incoming mail from the mailbox and closes the lid, the free end of the flag shaft is reinserted into the aperture in the holder plate and the flag is hold in a lowered position.

THE DRAWINGS

The presently preferred embodiment of the invention is disclosed in the following description and in the accompanying drawings wherein.

THE PREFERRED EMBODIMENTS

Figure 1:
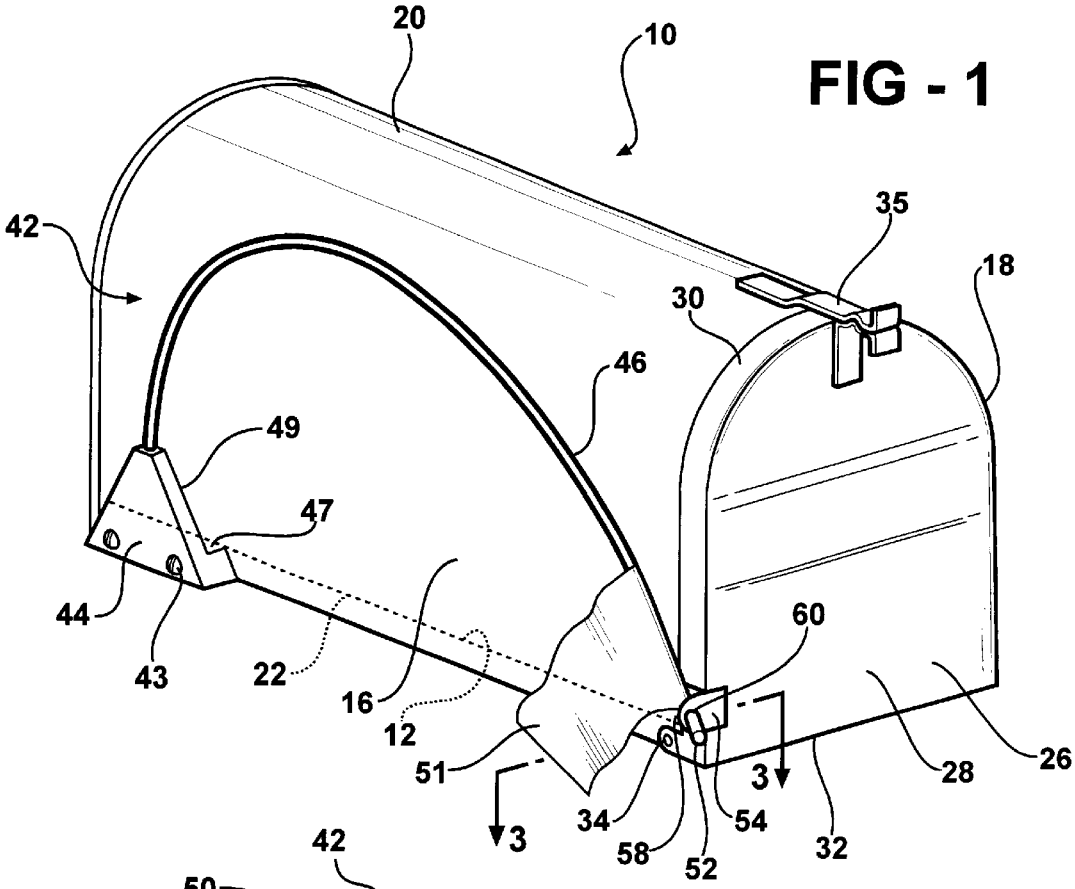
FIG. 1 is a perspective view of the mailbox with a primary flag and a secondary flag in a lowered position.

The rural mailbox 10 is a standard mailbox approved by the Post Master General for use on mail routes where the mail is delivered to the mailbox from a vehicle. The mailbox 10 has a floor 12 and a rear wall 14. Side walls 16 and 18 and top 20 are formed from a single sheet of material that is secured to flanges 22 and 24 that are integral with the sides of the floor 12. The rear wall 14 is secured to the floor 12, the side walls 16 and 18 and to the top 20.

A mailbox lid 26 has a front panel 28 and a flange 30 that is integral with all of the panel edges except the bottom edge 32. The ends of the flange 30. are pivotally secured to the side walls 16 and 18 and to the flanges 22 and 24 for pivotal movement about an axis 34 that is below and parallel to a plane including the upper surface of the floor 12. When the lid 26 is in an open position, the entire front of the mailbox 10 is open. A latch assembly 35 holds the lid 26 in a closed position.

A standard mailbox flag 36, which is required by the Postal Department, is pivotally attached to the side wall 18 near the front opening 38. The flag 36 can be made from metal or semi-rigged plastic. In an up position the flag standard 40 is generally vertical. The flag standard 40 is pivoted to a generally horizontal position when the flag 36 is in a down position.

The function of the rigid flag 36 is to inform a mail carrier that the Post Office patron has placed something in the mailbox 10 for the mail carrier to pick up. This material in the mailbox 10 could be outgoing mail, mail that was improperly delivered to the mailbox, a request for stamps or some other document relating to services provided by the postal service. After a mail carrier has retrieved materials deposited in the mailbox 10 by a patron, the standard flag 36 is pivoted to a down position in which the flag standard 40 is generally horizontal. During use of the mailbox flag 36, for its intended purpose, the mailbox flag is raised by a Post Office patron and lowered by a mail carrier.

Figure 2:
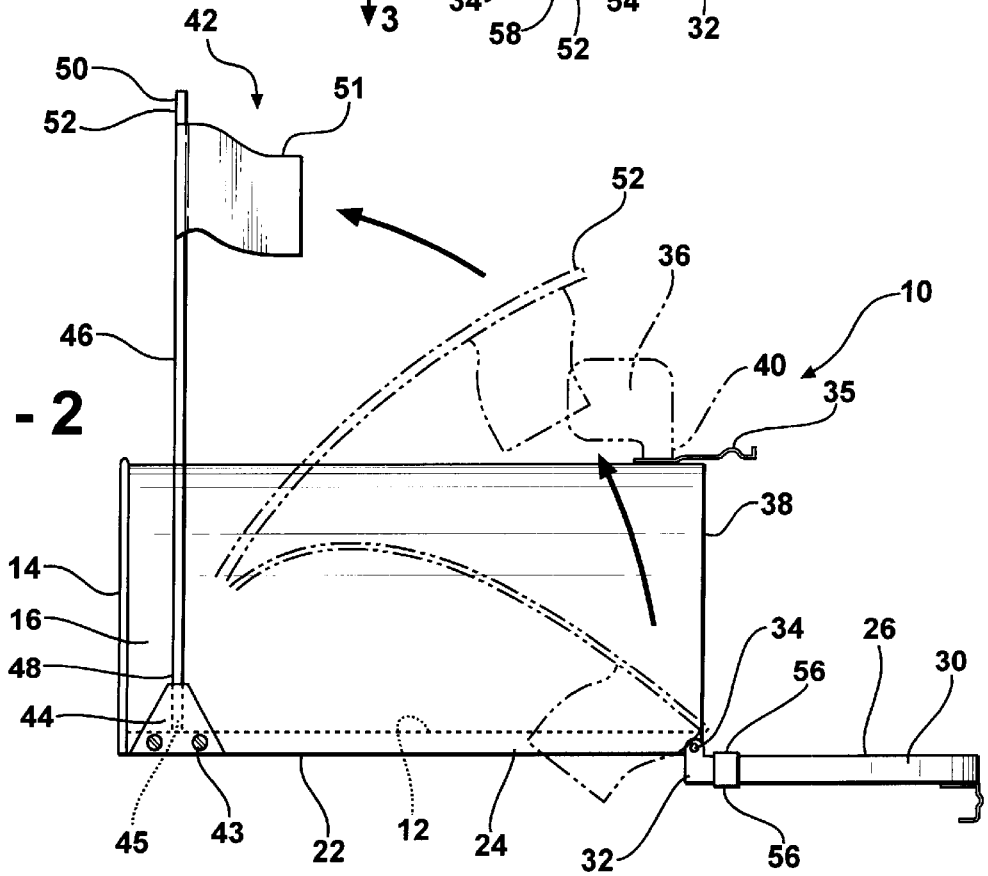
FIG. 2 is a side elevational view with the secondary flag raised.

A secondary flag assembly 42 has a holder 44 secured to the lower rear side of the side wall 16 by screws 43. The holder 44 has a flag shaft receiving bore 45. The receiving bore 45 as shown in FIG. 2 is vertical. A flexible flag shaft 46 has a base end 48 secured to the holder 44 by inserting the base into the flag shaft receiving bore. A free end 50 of the flexible flag shaft 46 is positioned vertically above the base end 48, when the shaft 46 is not deflected by outside forces. A flexible flag 51 that can flutter in the wind is secured to the flexible flag shaft 46 adjacent to a flag shaft tip 52 on the free end 50.

The holder 44, as shown in FIG. 1 includes a base member 47. The base member 47 gives the holder 44 an L-shape when viewed from the front. The purpose of the base member 47 is to move the upper portion 49 away from the side wall 16. Moving the upper portion 49 away from the side wall 16 provides additional clearance between the flexible flag shaft and the mailbox 10.

Figure 3:
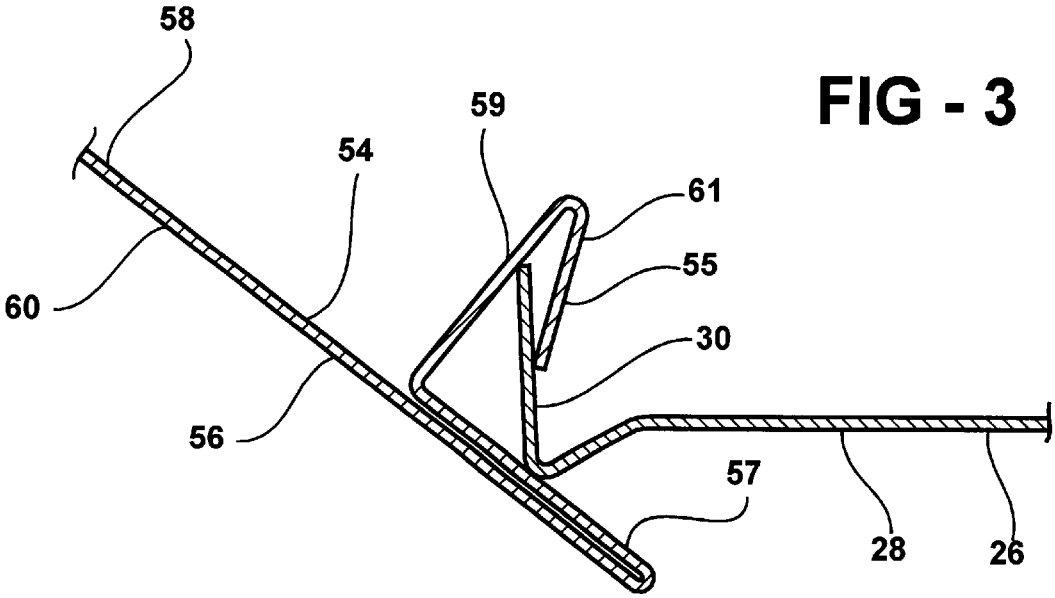
FIG. 3 is an enlarged sectional view taken along lines 3—3 in FIG. 1.
Figure 4:
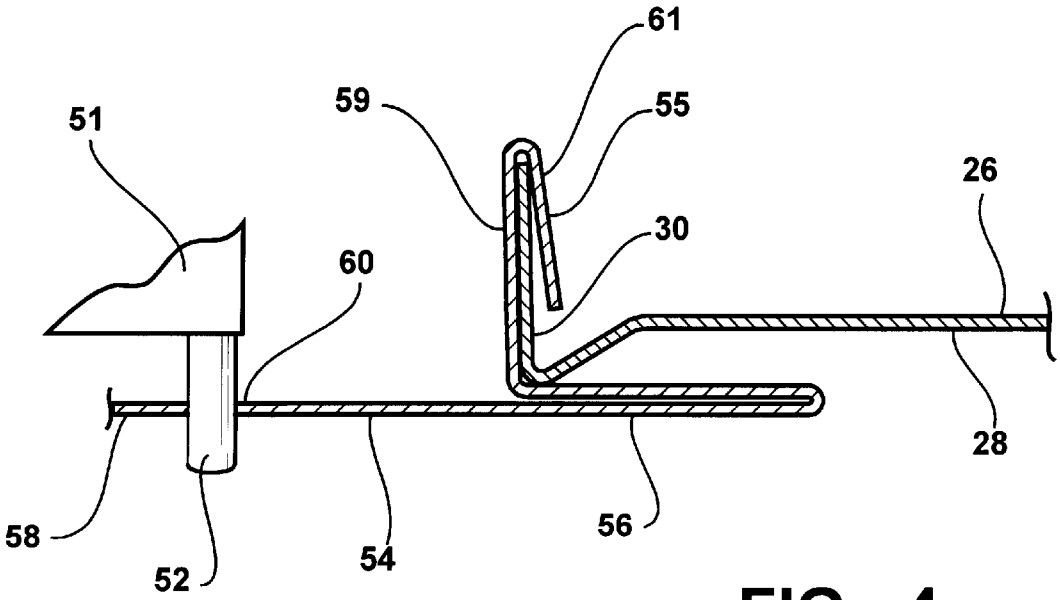
FIG. 4 is an enlarged sectional view similar to FIG. 3 showing the flag shaft tip holder plate attached to the mailbox lid.

A flag shaft tip holder plate 54 is secured to the mailbox lid 26 by integral fingers 55. A flat plate portion 56 of the holder plate 54 is held parallel to an outside surface of the front panel 28 of the mailbox lid 26 and has an outboard end 58 that extends outwardly from the flange 30. The integral fingers 55 wrap around the flange 30 and hold the holder plate 54 in place. The integral fingers 55 include a first plate 57 that is integral with and parallel to the flat pate portion 56, a second plate 59 that is integral with the first plate 57 and generally perpendicular to the flat plate portion 56, and a portion 61 with one or more fingers 55 that are integral with the second plate 59. The portion 61 with the fingers 55 is bifurcated to reduce the force required to attach the flag shaft tip holder plate 54 to the flange 30 of the mailbox lid. The portion 61 with the fingers 55 is sprung away from the second plate 59, as shown in FIG. 4 when attaching the flag shaft tip holder plate 54 to the mailbox lid 25. If the fingers 55 are too rigid, the flange 30 will be bent when securing the flag shaft tip holder plate 54 to the mailbox lid 26. The fingers 55 spring back toward the second plate 59, as shown in FIG. 3, when the holder plate 54 is mounted on the mailbox lid 26 so that the flange 30 can close and engage the side walls 16 and 18 and the top 20. A small aperture 60 in the outboard end 58 of the flat plate portion 56 of the holder plate 54 functions as a flag shaft tip holder that holds the flag tip 52 in a lowered position, as shown in FIG. 1.

The Post Office patron bends the flexible flag shaft 46 to move the flag shaft tip 52 into the small aperture 60 after incoming mail is removed from the mailbox 10 and the mailbox lid 26 is closed. The flag shaft tip 52 is held in a downward position by the small aperture 60 which receives the flag shaft tip 52. When the mailbox lid 26 is opened by a mail carrier to deposit incoming mail in the mailbox, the flag shaft tip 52 is released from the aperture 60, the flexible flag shaft 46 straightens and the flexible flag 51 is held high above the mailbox 10. In the position high above the mailbox 10, the flexible flag 51 can be seen for a substantial distance and indicates that there is likely to be incoming mail in the mailbox. The raised position of the flexible flag 51 high above the mailbox 10 is easily observed and distinguished from the rigid flag 36 by a mail carrier. However, if the preferred procedure is followed, the secondary flexible flag 51 is held in the aperture 60 at mail delivery time.

The secondary flag assembly 42 is moved into a lowered position by a Post Office patron after incoming mail is removed from the mailbox 10 and the mailbox lid 26 is closed. Upon opening the lid 26 by a mail carrier to deposit incoming mail in the mailbox, the flag shaft tip 52 is released from the aperture 60 and the flexible flag shaft 46 is automatically raised thereby indicating the presence of incoming mail.

The holder 44 of the secondary flag assembly 42 can be attached to either side wall 16 or 18, the top 20, the rear wall 14, or the floor 12. If the position of the secondary flag assembly 42 is changed, the position of the flag shaft tip holder plate 54 on the mailbox lid 26 can be changed to accommodate the new location of the flag assembly. The flag shaft tip holder plate 54 can be in any position around the flange 30 of the mailbox lid 26 where it can be engaged by the flag shaft tip 52 and it will be moved a sufficient distance about the axis 34 of the lid 26 to release the flag shaft tip. The flag shaft tip holder plate 54 could also be attached to the lid 26 by mechanical fasteners if desired.

The flexible flag shaft 46 is flexible from its base end 48 to the flag shaft tip 52 as shown in the drawing. If desired, the flexible flag shaft 46 could have one or more flexible sections and rigid sections.

It is to be understood that other embodiments of the invention which accomplish the same function are incorporated herein within the scope of any ultimately allowed patent claims.

The disclosed embodiment is representative of a presently preferred form of the invention, but is intended to be illustrative rather than definitive thereof. The invention is defined in the claims.

I claim:

1. A rural mailbox comprising:

an enclosure having a floor, a first side wall, a second side wall, a rear wall and an open front;

a mailbox lid pivotally attached to the enclosure adjacent to the floor and pivotal between a closed position in which the open front is closed and an open position in which the open front is open;

a standard mailbox flag assembly including a rigid standard having a standard base that is pivotally attached to the first side wall adjacent to the open front and a rigid flag on a free end of the standard;

a secondary flag assembly including a flexible flag shaft with a base fixed to the enclosure adjacent to the rear wall and a flag attached to the flexible flag shaft adjacent to a flag shaft tip of the flexible flag shaft; and a flag shaft tip holder attached to the mailbox lid for receiving and holding the flag shaft tip when the mailbox lid is in the closed position and for releasing the flag shaft tip when the mailbox lid is in the open position, said flag shaft tip holder including a plate portion that extends outward from the mailbox lid and an aperture through the plate portion for receiving the flag shaft tip when the mailbox lid is in the closed position, said flag shaft tip holder including an integral finger portion that wraps around a mailbox lid flange and self-secures said flag shaft tip holder to said mailbox lid without the use of any fasteners or adhesive or alteration of the mailbox lid flange.

2. A rural mail box as set forth in claim 1 wherein the flag shaft tip holder is a spring steel member that grips the mailbox lid.

3. A mailbox flag kit, for indicating that a mail carrier has placed mail in a mailbox, comprising;

a flag holder having a flag shaft receiving bore and at least one anchoring fastener bore;

at least one anchoring fastener for clamping the flag holder in a fixed position;

a flexible flag shaft with a base end that is receivable in the flag shaft bore to hold the base end in a fixed position, and a flag shaft tip;

a flag attached to the flexible flag shaft adjacent to the flag shaft tip; and a springy flag shaft tip holder plate having an outboard end with a flag shaft tip receiver that receives the flag shaft tip to hold the flag in a lowered position, and a mailbox lid flange engaging end that removably self-mounts to a mailbox lid flange and operates to secure the flag shaft tip holder to the mailbox lid flange without the assistance of any fasteners or adhesive or alteration of the flange.

4. A mailbox flag kit as set forth in claim 3 including a second anchoring fastener bore in the flag holder;

and a second anchoring fastener.

5. A mailbox flag kit as set forth in claim 3 wherein the mailbox lid engaging end of the flag shaft tip holder plate includes a mailbox lid flange engaging finger imparting the self-mounting characteristic to the flag shaft tip holder plate.

6. A mailbox flag mounting method comprising:

mounting a flag holder in a fixed position adjacent to a rear portion of a mailbox and spaced from a mailbox lid;

inserting a base end of a flexible flag shaft in a flag shaft bore in the flag holder; and removably attaching a flag shaft tip holder plate to a flange of a mailbox lid with a holder plate outboard end extending away from the mailbox lid and with a flag shaft tip receiver in the holder plate in a flag shaft tip receiving position without altering the mailbox lid by drilling holes or securing fasteners or using adhesive to hold the flag shaft tip holder plate on the flange.

7. A mailbox flag mounting method as set forth in claim 6 wherein mounting the flag holder includes clamping the flag holder to a side of the mailbox adjacent to a mailbox rear wall.

8. A mailbox flag mounting method as set forth in claim 6 wherein attaching the flag shaft tip holder plate to the mailbox lid includes forcing at least one finger attached to the flag shaft holder plate into engagement with the side flange of the mailbox lid.

9. A mailbox flag kit, comprising:

a base mountable adjacent a side of a mailbox in spaced relation to a hinged lid of the mailbox and having a bore;

a flag pole supported at a lower end thereof by said bore and extending therefrom to a free end, said pole being fabricated of a resiliently flexible material capable of enabling said pole to be bent into an arc between said ends under a bending load and returning to a substantially upright straight position upon releasing said load;

a flag fixed to said pole adjacent said free end;

a retainer formed as a separate structure from said base and said pole, said retainer including mounting features enabling said retainer to be removably attached to a flange of the lid of the mailbox without fasteners or adhesive and without altering the flange for hinged movement therewith in spaced relation to said base; and said retainer including a releasable pole catch for engaging and holding said pole in a bent condition when the mailbox lid is closed and for releasing said pole in response to opening the mailbox lid to release the bending load enabling said pole to spring to said upright position, whereby the raised flag may operate to signal the owner of the mailbox from a distance that a mail carrier has delivered the mail by action of opening the lid and releasing said pole.

10. The mailbox flag kit of claim 9 wherein said flag is spaced from said free end of said flag pole leaving an exposed stub end of said pole extending beyond said flag.

11. The mailbox flag kit of claim 9 wherein said pole catch of said retainer comprises an aperture sized to receive and releasably hold said stub end of said pole.

12. A mailbox flag kit of claim 9 wherein said base includes an upright wall and a transverse leg extending laterally from said upright wall.

13. A mailbox flag kit of claim 12 wherein said transverse leg includes fasteners adapted to mount said base to said mailbox with said upright wall in spaced relation to said mailbox.

14. A mailbox flag kit of claim 9 wherein said retainer comprises a spring clip.

15. A mailbox flag kit of claim 14 wherein said spring clip includes mounting features enabling said retainer to be mounted to said lid without said use of fasteners.

* * * * *